US010801721B2

(12) United States Patent
Peserico

(10) Patent No.: US 10,801,721 B2
(45) Date of Patent: Oct. 13, 2020

(54) GAS-FIRED BOILER HAVING A HIGH MODULATION RATIO

(71) Applicant: POLIDORO S.P.A., Schio (VI) (IT)

(72) Inventor: Domenico Peserico, Valdagno (IT)

(73) Assignee: POLIDORO S.P.A., Schio (VI) (IT)

( * ) Notice: Subject to any disclaimer, the term of this patent is extended or adjusted under 35 U.S.C. 154(b) by 350 days.

(21) Appl. No.: 15/746,451

(22) PCT Filed: Jul. 20, 2016

(86) PCT No.: PCT/IB2016/054315
§ 371 (c)(1),
(2) Date: Jan. 22, 2018

(87) PCT Pub. No.: WO2017/013596
PCT Pub. Date: Jan. 26, 2017

(65) Prior Publication Data

US 2018/0202658 A1 Jul. 19, 2018

(30) Foreign Application Priority Data

Jul. 21, 2015 (IT) ..... UB2015A2343

(51) Int. Cl.
*F23N 5/00* (2006.01)
*F23N 1/02* (2006.01)
(Continued)

(52) U.S. Cl.
CPC ..... *F23N 5/003* (2013.01); *F23D 14/02* (2013.01); *F23D 14/34* (2013.01); *F23D 14/60* (2013.01);
(Continued)

(58) Field of Classification Search
CPC ..... F23D 14/60; F23D 14/70; F23N 2237/10; F23N 1/02; F23N 5/003
(Continued)

(56) References Cited

U.S. PATENT DOCUMENTS 1,765,549 A * 6/1930 Thurm ..... F23D 14/60 431/90
2,408,114 A * 9/1946 Urquhart ..... F23D 14/60 137/88
(Continued)

FOREIGN PATENT DOCUMENTS

EP 2014979 A2 1/2009
EP 2286149 A2 2/2011
(Continued)

*Primary Examiner* — Grant Moubry
*Assistant Examiner* — Aaron H Heyamoto
(74) *Attorney, Agent, or Firm* — King & Schickli, PLLC

(57) ABSTRACT

A gas-fired boiler comprises at least one burner (1) and feeding means (4) for feeding a fluid to such burner (1), said feeding means (4) being connected to a fan (5), a gas duct (7) being provided to feed gas to said fan (5). The burner comprises at least a first main flame-diffuser element (25) and a second auxiliary flame-diffuser element (26, the feeding means being a feeder duct (4) connected to the main diffuser element (25) and to the fan (5), said fluid comprising air or a mix of air and gas which is sent in such feeder duct (4), a tubular body (17) connected to the auxiliary diffuser element (26) opening in said duct (4), a gas carrying pipe (10) opening directly in such tubular body (17).

11 Claims, 5 Drawing Sheets

(51) Int. Cl.
*F23D 14/02* (2006.01)
*F23D 14/34* (2006.01)
*F23D 14/60* (2006.01)

(52) U.S. Cl.
CPC ..... *F23N 1/02* (2013.01); *F23D 2900/00017* (2013.01); *F23D 2900/14062* (2013.01); *F23N 2229/00* (2020.01); *F23N 2237/10* (2020.01)

(58) Field of Classification Search
USPC ..... 431/76
See application file for complete search history.

(56) References Cited

U.S. PATENT DOCUMENTS

| | | | | |
|---|---|---|---|---|
| 3,319,887 | A * | 5/1967 | Gallagher | G05D 23/1934 236/15 R |
| 4,645,450 | A * | 2/1987 | West | F23N 1/022 431/12 |
| 6,179,212 | B1 * | 1/2001 | Banko | F23N 1/005 236/1 E |
| 2007/0292811 | A1 * | 12/2007 | Poe | F23D 14/08 431/116 |
| 2018/0237323 | A1 * | 8/2018 | D'Agostini | C03B 5/2353 |
| 2019/0242583 | A1 * | 8/2019 | Paller | F23N 5/265 |

FOREIGN PATENT DOCUMENTS

| | | |
|---|---|---|
| JP | 2006258304 | 9/2006 |
| WO | WO2006019279 A1 | 2/2006 |

* cited by examiner

GAS-FIRED BOILER HAVING A HIGH MODULATION RATIO

TECHNICAL FIELD

The present invention relates to a gas-fired boiler according to the preamble of the main claim.

BACKGROUND

Specifically, the invention relates to a boiler provided with a burner operating with a variable and high modulation ratio (obviously according to the presence and dimensions of its individual components), said boiler being suitable for heating a fluid (for instance, water) for sanitary use and/or for heating a room.

It is known that a gas-fired boiler with a burner having a variable modulation ratio of the mentioned type comprises a burner of a premixed fluid feeding type (i.e. operating with a mix of air and gas present in adjustable or modulatable proportions); such burner is currently implemented together with components operating according to two different main modes, i.e. a pneumatic mode and an electronic mode. Both of these modes make it possible to optimize the air to gas ratio of the premixed fluid sent to the burner in order to maintain a combustion that is uniform and conforming to the regulations or standards in force (in particular, for that which concerns emission of polluting gases).

However, both of these embodiments of the known boilers have difficulties in performing a modulation of the flowrate of the air/gas mix fed to the burner, especially in correspondence with the minimum flowrate value corresponding to a low thermal power generated by the burner.

SUMMARY

In general, the known boilers with flame modulation burners comprise one or more burners (having, for instance, a plane or cylindrical shape) having a diffuser element whereon a flame is generated. The burners are located in a combustion chamber and a pre-mixed (air/gas) fluid is fed thereto via a feeding duct connected to a fan. The fan generates an air flowrate with a pressure related to the revolutions per minute of the fan itself. In the feeding duct (where air moved by the fan is present) there is also present gas from a gas pipe connected to the feeder duct via a (gas) control valve.

Thus, in the state of the art boilers are known for heating sanitary water and/or for heating rooms; said known boilers have a plurality of burners, wherein each of them is fed from a corresponding feeding duct which a fan is connected to (or not).

In such solutions, including those based on a pneumatic duct, i.e. based on the use of pneumatic gas control valves, and those based on an "electronic" concept (wherein such valves are driven by an actuator controlled by a control unit operating on the basis of an algorithm which takes account, for instance, of a flame signal detected on the burner as compared to a preset reference signal), the above mentioned difficulties are still experienced.

In particular, in a burner fed via a pneumatic valve, the flame modulation shortcomings result from the difficulty of having a minimum air pressure to have a correct operation of the gas valve, and from the reduced number of revolutions per minute of the fan such as to allow a stable operation suitable for warranting a correct and desired mixing of air and gas. Such shortcomings can be overcome by using special components (for instance a double Venturi mixer or a fan capable of operating at low revolutions per minute).

In those boilers in which the gas valve is controlled electronically (but this is also true for a pneumatically controlled valve), the shortcomings in modulation operation is related to the instable operation of the fan at reduced speeds and to the difficult implementation of a correct air/gas mix (in terms of emission of pollutants) whenever the fan operates at said reduced speeds. Also, (for electronically-controlled valves only) there is also the possibility that the flame signal used to control the gas valve becomes instable and difficult to detect whenever the flame is so close to the surface of the burner as to make the latter emit heat by radiation (a so-called "radiating burner" phase); in this event, whenever such signal is obtained via a sensor operating on a ionization current, the detected flame signal is not comparable any longer to the reference signal (bound to different operating diagrams of the burner) and said signal does not allow to evaluate the type of the mix (whether rich or low in gas) either, and consequently the gas valve is not correctly controllable any longer.

Document JP-2006-258304 describes a gas-fired burner for cooktops comprising a plurality of coaxial zones where flames (or combustion zones) are generated. The heating power of the burner is varied by activating one or more of said coaxial combustion zones.

This prior art document describes the presence of a primary duct connected to a fan, and gas is injected between the fan and the burner via side channels connected to a pressure equalizer valve which a gas feeding duct is connected to.

Such primary duct is connected to the central combustion zone and to the side combustion zones coaxial to the central one via pipes coaxial to each other; gas can be fed to such coaxial pipes via the side channels on which corresponding valves are installed.

This prior art document does not describe an invention applied to the gas-fired burners field for boilers that have heating powers much higher than those which can be generated by a gas-fired burner of a cooktop. Furthermore, in the prior art all combustion zones are associated with one body.

In the known solution it is possible to stop feeding gas to pipes coaxial to each other and to the central one by closing the main valve and it is therefore possible to feed gas to one or more pipes or to the main duct by opening the valves of the side ducts (connected to a main gas supply duct also connected to the main valve).

This known solution, as already said, does not describe a gas-fired burner for boilers of the type operating with a variable and high modulation ratio, nor does it describe a burner for boilers having flame diffuser elements separated from each other and which can be autonomously activate via an autonomous gas feeding made possible by a valve member placed inside one air/gas mix feeding duct which feeds said diffuser elements.

Document WO 2006/019279 describes a pre-mixed gas-fired burner that comprises a burner body which receives air from a fan and gas from at least one corresponding gas duct. Such burner body includes a widened portion on an upper combustion surface of which a plurality of flame diffuser units are placed having a plurality of holes for flames. The maximum output capacity of the burner is determined by the number of flame diffuser units that are mounted on the burner.

The burner body gradually widens both in the front direction and in the rear direction, as well as laterally, so as to form a path for the air flow in the vertical direction, with no bent parts towards the combustion surface.

Rectification plates are present inside the burner body to uniformly mix gas and combustion air; dividers are also present to uniformly spread the gas having been pre-mixed with air. The rectification plates are provided with a plurality of holes.

In the known solution, the burner's generated power is determined by the number of flame diffuser units, the number of dividers being a function of the number of such units.

In use, the gas provided by a corresponding pipe spreads within the burner body towards all flame diffuser units and also passes through the rectification plates.

Therefore, the prior art document does not describe any other way for modifying the burner's generated power, but those related to the provision of a specific number of flame diffuser units or closing part of the holes of one of such units. Also, the burner according to this prior art is a burner having flame diffuser units that are permanently fed with the air/gas mix, without any possibility of (or need for) stopping the flow of such mix towards the complete combustion surface where the flame diffuser units are present.

Finally, the document under consideration does not present any movable valve members in the air/gas mix feeding duct, a valve member that is not necessary or usable either because all portions of the burner body are and shall always be hit by the air and gas flow to make it possible flame generation on the diffuser units provided.

There would be no need for providing a valve member that chokes or directs the movement of gas and air inside the burner body because in the prior art it is described that all flame diffuser units are suitable for presenting a flame since the number of their flame holes is selected a priori as a function of the calorific power the burner shall generate.

An object of the present invention is to offer a pre-mixed boiler for heating sanitary water and/or for heating house room, having a high modulation ratio, i.e. a pre-mixed boiler for heating sanitary water and/or for heating house room having a high modulation ratio, or a gas-fired boiler with a burner operating with a continuously or discretely variable and high modulation ratio that overcomes the shortcomings and drawbacks of the known solutions.

Another object is to offer a pre-mixed boiler of the mentioned type that has a burner featuring a high modulation ratio while maintaining one fan and one gas security valve.

Another object is to offer a boiler of the mentioned type that allows to stabilize the flame on the burner in correspondence with very small flowrates.

Additionally, a further object is to offer a boiler of the mentioned type wherein there is a strong reduction of the thermoacoustic problems inherent to the known pre-mixed boilers and generating in the combustion chamber.

Another object is to provide a boiler wherein burner ignition is made simpler so as to prevent explosion phenomena in the combustion chamber.

These objects and others that will be apparent to those skilled in this art are achieved by a boiler according to the attached claims.

BRIEF DESCRIPTION OF THE DRAWING FIGURES

For a better understanding of the present invention, the following drawings are attached for merely explanatory, but not limitative, purposes, wherein.

DETAILED DESCRIPTION OF THE INVENTION

Figure 1:
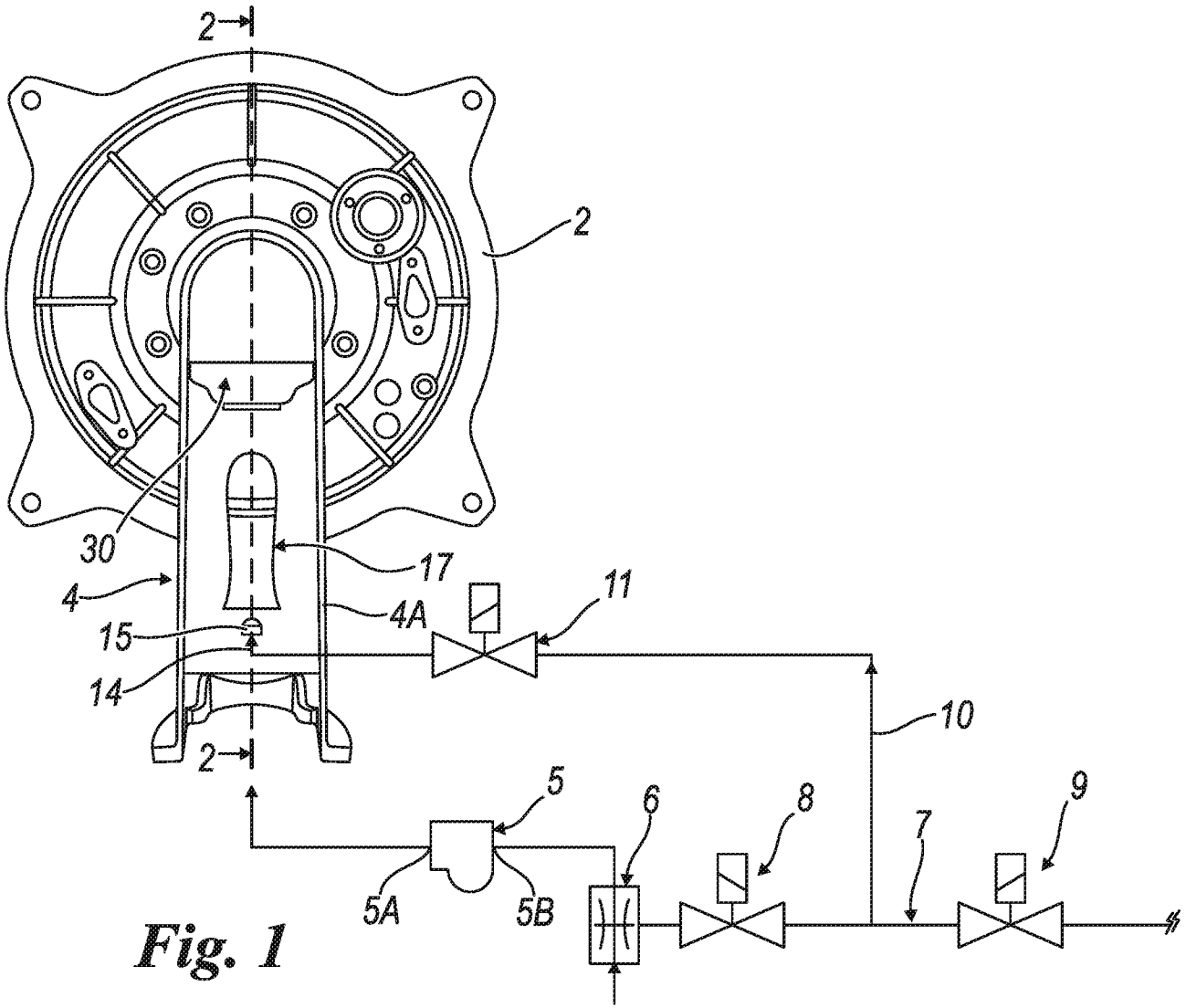
FIG. 1 shows a bottom and schematic view of a boiler according to the invention including a burner with the components of such boiler, connected to the burner itself, schematically shown.
Figure 2:
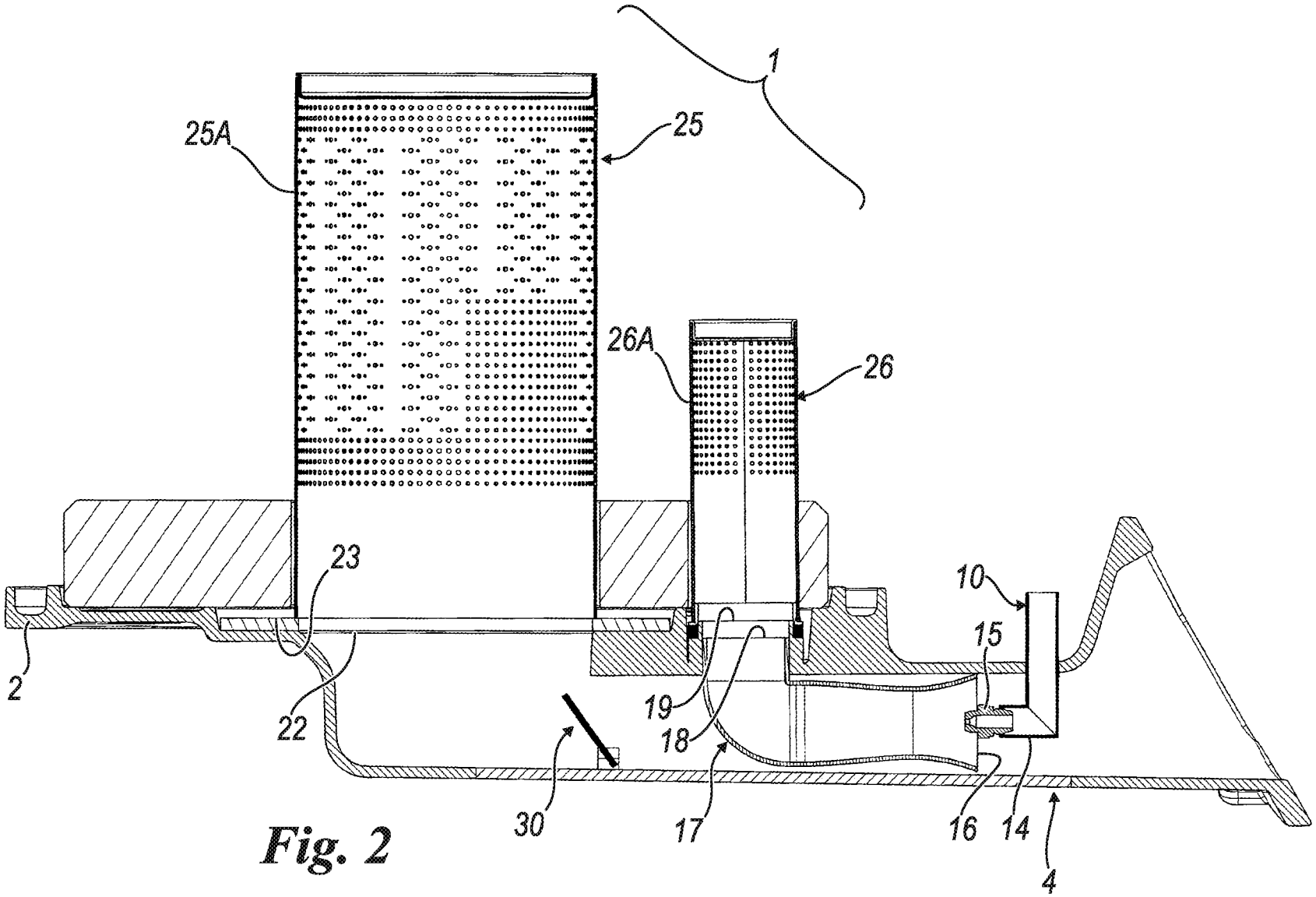
FIG. 2 shows a view according to line 2-2 in FIG. 1.
Figure 3:
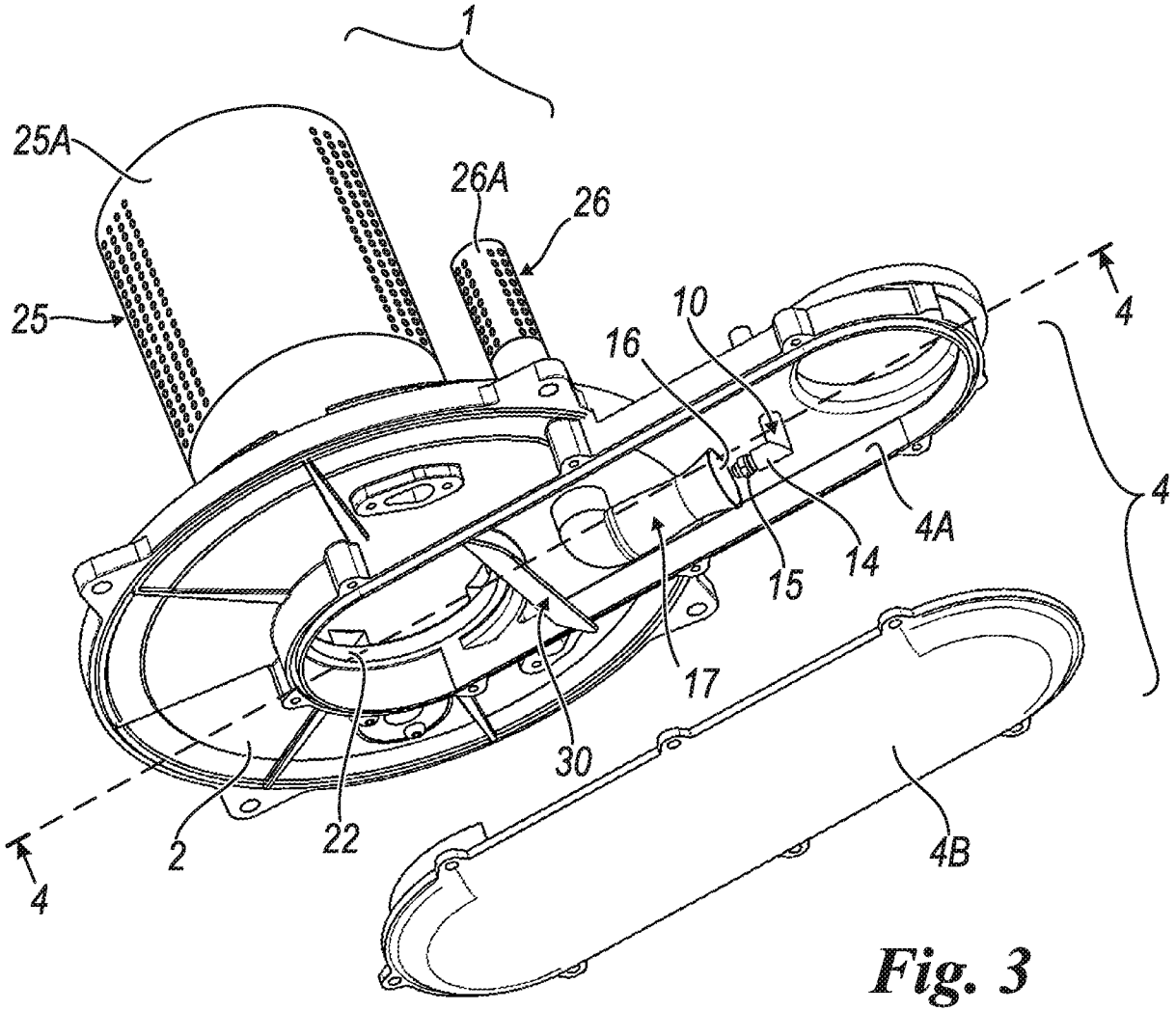
FIG. 3 shows an exploded view of that part of the boiler of FIG. 1 which is associated with the burner.
Figure 4:
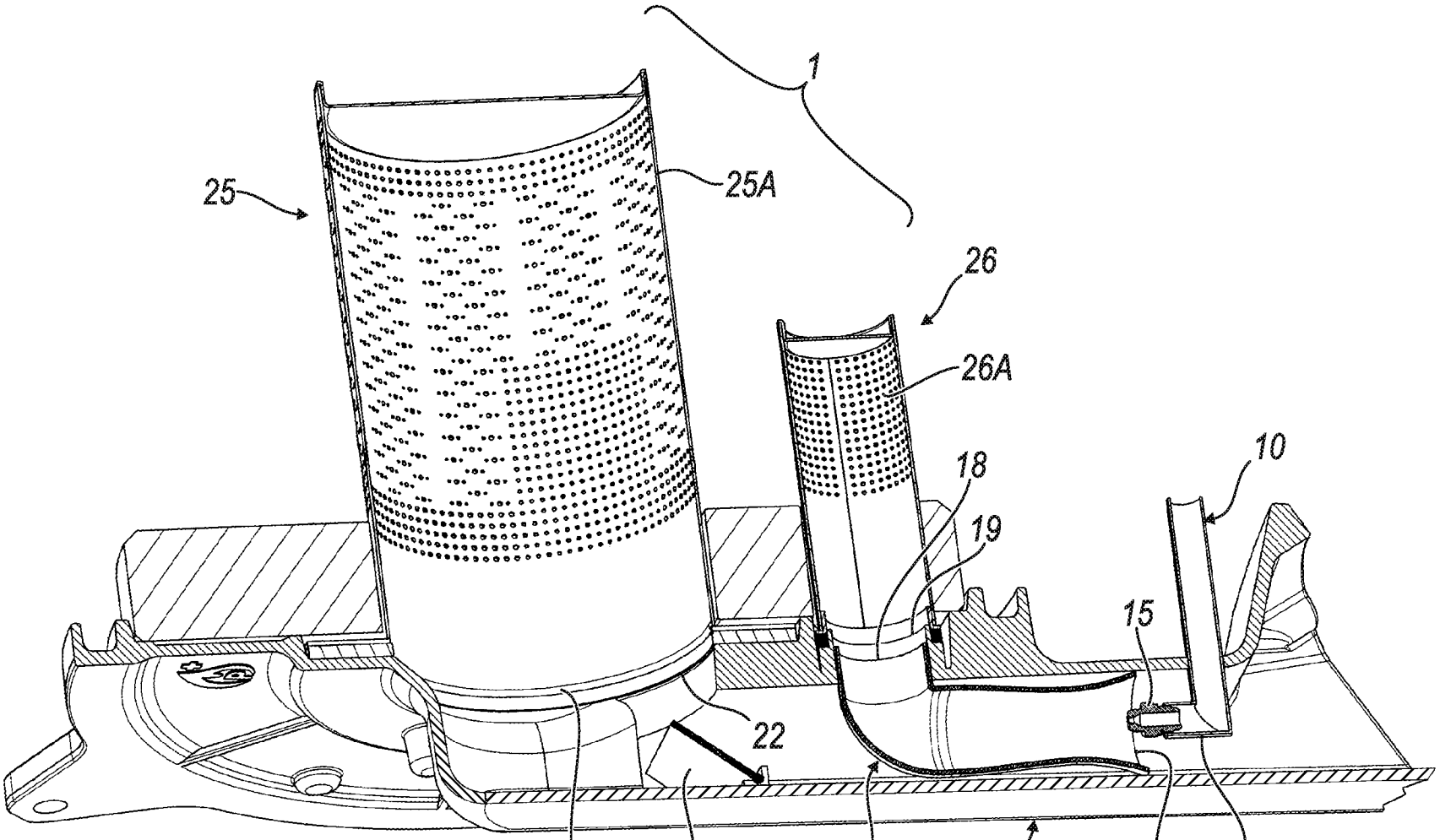
FIG. 4 shows a cross-sectional view according to line 4-4 in FIG. 3.

With reference to the mentioned FIGS. 1 thru 4, a boiler with a burner featuring a variable modulation ratio comprises a burner 1 associated with a support element 2 ("burner door") which a (primary) feeding duct 4 is secured to, in a known way (for instance mechanically by way of screws or by welding), suitable for feeding a fluid to the burner. Such fluid might be air or a mix of air and gas. The duct 4 possibly includes a hollow body 4A closed by a cover 4B.

For this purpose, the feeding duct is associated with an outlet 5A of a fan 5 whose inlet 5B is connected, in the non-limitative embodiment here considered, to a mixer 6. However, such mixer might be also placed downstream of the above mentioned outlet 5A. A main gas valve 8, of a pneumatic or electronic control type, is connected to a gas duct 7 on which a security valve 9 is also placed.

In the embodiment shown in the figures, which is provided for explanatory but non-limitative purposes, the gas duct 7 includes an offtake or pipe 10 placed before the valve 8 (as referred to the direction of the gas flow in the duct 7) and on which a valve 11 is located. Such pipe 10 terminates in an end 14 (where a nozzle 15 is located, secured in any known manner). Such end 14 of the pipe 10 (or secondary feeding pipe) is located at a first opening or end 16 of the tubular body 17 having a second end or opening 18 secured to an opening 19 of the support element 2 of the burner 1. It goes without saying that, as well known to those skilled in this art, other solutions are possible, as described herein later. Likewise, the (primary) feeding duct 4 has an end 22 that is open and located in correspondence with an opening 23 of said support element 2.

The burner 1 comprises two physically separated flame diffuser elements 25 and 26, the first element 25 being the primary diffuser element and the second element 26 being the auxiliary or secondary diffuser element. Such diffuser elements 25 and 26, placed away from each other and secured to the element 2 in any known manner, for instance screwed in, welded, or the like, can be simultaneously active (i.e. have a flame diffused along their corresponding slit surfaces 25A and 26A) or (as shown in the figures) only the secondary diffuser element 26 might be active. However, as described later, a solution is also possible that allows the operation of the primary diffuser element 25 only, of the secondary diffuser element 26 only or both.

The diffusers 25 and 26 are suitable for generating different heating powers since they have different surfaces 25A, 26A on which the flame is generated.

With respect to the embodiment depicted in the figures, the above operation is made possible by the presence of a clapet valve 30 between the tubular body 17 and the primary diffuser element 25, placed within the feeding duct 4. Such valve or on/off member or choking member is suitable not only for completely closing the cross-section of the duct in which it is placed (thus totally stopping the air/gas mix flow towards the primary diffuser element 25) but it is also suitable for choking the flow in transit towards such primary diffuser element 25.

The member or valve 30 can be moved by gravity or by the pressure exerted by the fluid coming from the fan 5 or it might be a slave valve, controlled by a corresponding actuator (not shown).

In the latter event, such actuator is subject to the control by a control unit of the boiler (not shown) which also controls the operation of the fan 5 and of the gas valves 8, 9, and 11.

In a variant of the invention, the tubular body 17 is located, in the duct 4, downstream of the primary diffuser element (as referred to the direction of the flow of the air/gas mix or of the air only coming from the fan 5) and the clapet valve 30 is located between the first opening 16 of such duct and said primary diffuser element. In this event, in the continued assumption that the pipe 10 opens within the tubular body 17, it is possible to have the flame activated on the primary diffuser element 25, or on the secondary one 26, or on both. If the flame is activated on the element 25 only, the clapet valve 30 is in such position as to close the duct 4 downstream of such element: the air/gas mix that comes from the fan 5 is thus in a position to enter the element 25 only and to generate a flame on its surface 25A.

If the valve or on/off member 30 is open, the air/gas mix injected by the fan 5 into the duct 4 can reach both diffuser elements 25 and 26, and in this way it is possible to generate a flame on both surfaces 25A and 26A thereof. In such solution the valve 11 shall be closed.

If the gas valve 8 is closed and the gas valve 11 is open, so as to keep the on/off member 30 open, it is possible to activate a flame on the auxiliary diffuser element 26 only, which receives gas from the pipe 10 and air (only) from the duct 4. Such air also enters the primary diffuser element 25, but without generating a flame thereon (because there is no gas).

All of this makes it possible to generate different calorific powers with the diffusers 25 and 26.

A situation similar to that described above might also be obtained with the solution depicted in FIGS. 1 thru 4, provided a further valve or on/off member (not shown in the figures) is placed inside the tubular body 17. In this event, opening the member 30, closing the valve 11, opening the valve 8, and closing the on/off member placed in the body 17 makes it possible to feed the air/gas mix present in the duct 4 to the primary diffuser element 25 only and to generate a flame thereon only.

According to a further variant, which is not part of the scope of the invention according to attached claims, the on/off member 30 might also not be present in the duct 4 both in the embodiment shown in FIGS. 1 thru 4 and in the embodiment which has the tubular body 17 mounted downstream of the primary diffuser element 25 (in such duct, as referred to the direction of the air or air/gas flow from the fan 5). In this event, both diffuser elements 25 and 26 can be "activated" (i.e., a flame can be generated thereon) if an air/gas mix is injected from the fan 5 into the duct 4. If air only is injected into this duct (i.e. the valve 8 is closed) and simultaneously only the valve 11 is open, then the secondary duct only can be activated.

Therefore, the invention results in a substantial versatility of the burner construction, while allowing a considerable modulability thereof as a function of the demands.

Thanks to the invention, an optimum modulation ratio can be obtained for the burner 1, including two (or more) flame diffuser elements 25 and 26, suitable for generating different calorific powers, separated from each other and fed from only one, single feeding duct 4 in which an air/gas mix can flow whenever both diffuser elements 25, 26 are operating or only air can flow whenever the valve 8 is closed, the valve 11 is open, and the fan 5 is activated in any way. In this event and with reference to the figures, this leads to the presence of a flame on the diffuser element 26 only. According to the variants here described, it is also possible to activate the primary diffuser element 25 only, the auxiliary element 26 only or both.

Let us suppose a pneumatic regulation boiler is used equipped with a burner 1 and a mixer 6 as shown in FIGS. 1 thru 4. In this event, the burner 1 operating at the nominal flowrate, the valve or on/off member 30 and the valve 8 are open, whereas the valve 11 is possibly closed. This leads to feed an air/gas mix to both diffuser elements 25 and 26 and both generate a flame. Obviously, these elements are properly engineered to get the desired modulation.

If the number of revolutions per minute of the (obviously already active) fan 5 is reduced as a function of the thermal demand coming from the boiler, then the system formed of the burner 1 and the valves associated therewith will respond correspondingly, the above described valve configuration remaining unchanged. When the number of revolutions per minute of the fan 5 reaches a preset value, the valve 11 is opened (provided it was not already open, in which event it is held in this operating position) and the valve 8 is closed so as not to have any stop of flame in the burner 1, but the diffuser element 26 only (which receives air from the duct 4 and from the tubular body 17 and gas from the pipe 10) has a flame. This prevents significant emissions of undesired pollutants.

At such number of revolutions per minute, a minimum desired gas flowrate is reached with an optimum combustion as determined by engineering the auxiliary (or secondary) diffuser element 26 and the gas fed through the pipe 10. The air that enters the element 26 has a flowrate generated by the fan 5 and by the appropriate positioning or by the on/off member 30 being completely closed. If this valve 30 is partially closed, then air only reaches the primary diffuser element 25, because the valve 8 is closed.

Thanks to the invention, an optimum combustion is achieved with the burner 1 reaching a desired modulation, by using components already present in the usual boilers, but with the addition of an auxiliary or secondary diffuser element 26, having a surface 26A on which the flame is generated smaller than the surface 25A of the primary diffuser element 25, the pipe 10, the body 17, and at least an on/off member 30, if any.

It is worth noting that the ignition of the primary or main diffuser element 25 can take place by using the secondary diffuser element 26 (or vice versa) with a minimum supply of air/gas mix to the element 25 too (by opening the valve 8 before closing the valve 11) without any explosion phenomena generating in the combustion chamber of the boiler where the burner 1 is located.

A similar operation is obtained if each one of the gas valves 8 and 11 is controlled electronically via a flame signal picked-up from either the main diffuser element 25 or the secondary diffuser element 26 which will be always present all over the operating range of the burner. This is accompanied by an appropriate drive of the valves 8 and 11 by the control unit of the boiler (for instance connected to a flame or smoke signal detector) present in the boiler which leads to their appropriate closing and/or opening as a function of the required burner modulation (the primary diffuser element 25 and/or the seconder diffuser element being activated).

Obviously, the boiler can be equipped with other sensors and/or detectors suitable for enabling said control unit to monitor its correct operation, for instance CO, $O_2$, and temperature sensors or the like, as known in the status of the art.

In a simplified embodiment of the invention, the pipe 10 is not provided and the activation of the secondary diffuser element 26 only is only obtained by closing the on/off member 30 and minimizing the flowrate of the air/gas mix coming from the fan 5 (which pre-mixes such air and gas). In this event, in a "electronic control" solution, the flame on the diffuser element 26 is controlled, for instance, via a known flame signal detector, which is sufficient to recognize and control combustion. Such solution, even though viable, presents a number of shortcomings related to the use of the fan and to the possible instability that generate therein.

Figure 5:
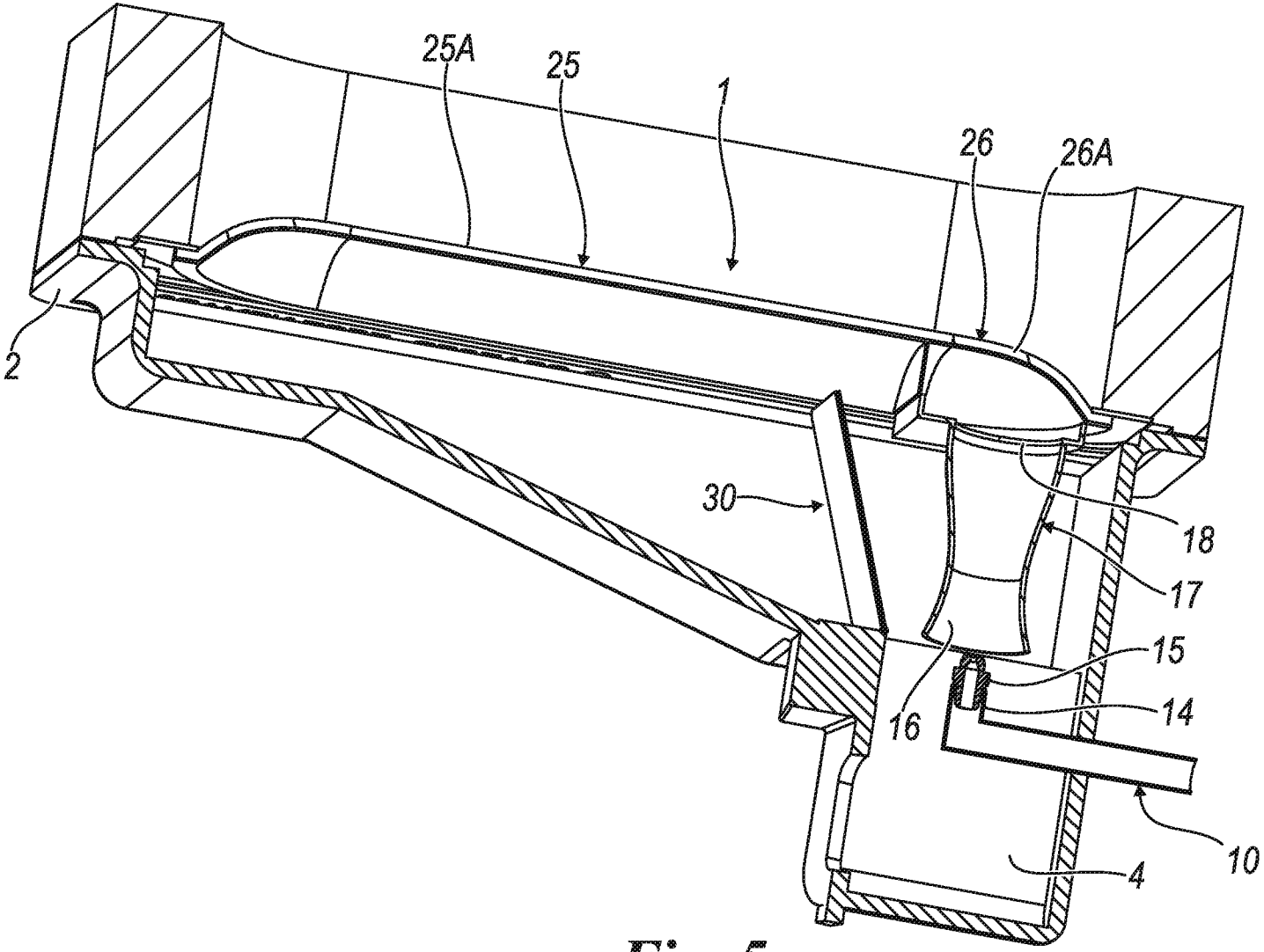
FIG. 5 shows a longitudinal sectional view of a variant of that part of the boiler which is associated with the burner according to the invention.

In FIG. 5, where parts corresponding to those already described are identified by the same reference numerals, a burner 1 is shown having a plane structure and wherein the two flame diffuser elements 25 and 26, still well separated and identifiable, are defined by adjacent zones of such plane burner. The latter can be a one-piece one and such diffuser elements are portions of such one-body well defined from the viewpoint of flame generation on the burner; alternatively, such plane burner might be defined by two adjacent and consecutive bodies defining such elements 25 and 26.

In the case of the FIG. 5 too, it is possible to have the air/gas mix fed to the auxiliary diffuser element 26 only or to both diffusers, similarly to what already described.

Therefore, the use of a plane burner with the two diffuser elements different from each other (in any way separated from each other) is similar to that described for the burner shown in FIGS. 1 thru 4 and will not be further described.

A number of embodiments of the invention have been described. However, others are possible in the light of the previous description (like that which includes a security valve associated with the pipe 10 and with the duct on which the valve 8 is placed) and consequently they are such as to fall within the scope of the invention as defined by the following claims.

The invention claimed is:

1. A pre-mix gas-fired boiler for heating a fluid for sanitary use and/or for heating a room comprising at least one burner (1) operating with a variable modulation ratio and a feeder (4) for feeding the fluid to such burner (1), said feeder (4) being connected to a fan (5), a gas duct (7) being provided for feeding gas to said fan (5) on which an on/off valve member (8) and a mixer (6) are provided, the burner (1) comprising a first main flame diffuser element (25) and at least one second auxiliary flame diffuser element (26), the feeder comprising one feeder duct (4) connected to the main diffuser element (25) and to the fan (5), the fan being a single fan connected to the feeder duct (4), said fluid comprising air or a mix of air and gas being sent, a tubular body (17) connected to the second auxiliary flame diffuser element (26) opening in said feeder duct (4) and, a gas carrying pipe (10) opening directly in the tubular body (17) so as to feed gas directly to the tubular body (17) being provided, wherein the first main flame diffuser element and second auxiliary flame diffuser element are elements separated from each other, they are suitable for generating different calorific powers, the first main diffuser element (25) having a surface (25A) on which flame is generated having a surface area greater than the corresponding surface area (26A) of the secondary diffuser element (26), an on/off member (30) being provided within the feeder duct (4) and placed between said tubular body (17) and said main flame diffuser element (25), said on/off member (30) being suitable for allowing flame generation only on either of said diffuser elements (25, 26) or on both so as to modify the calorific power generated by the burner (1), said main diffuser element (25) and said auxiliary diffuser element (26) being able to be activated independently of each other or jointly with each other.

2. The boiler according to claim 1, wherein said tubular body (17) is placed in the feeder duct (4) either upstream or downstream of the main flame diffuser element (25) in the direction of the air or air/gas mix flow in said duct (4).

3. The boiler according to claim 1, wherein a further on/off member is provided within the tubular body (17) suitable for interrupting the connection of the auxiliary flame diffuser element (26) to said feeder duct (4).

4. The boiler according to claim 1, wherein the gas pipe (10) is connected to the gas duct (7), the gas duct (7) being connected to the fan (5), said gas pipe (10) being placed upstream of the valve member (8) in the direction of the gas flow in the gas duct and includes a valve member (11) between said gas duct (7) and said tubular body (17), at least one security valve (9) being provided in the gas duct (7), said main diffuser element (25) and said auxiliary diffuser element (26) being able to be activated independently of each other.

5. The burner according to claim 1, wherein the burner is alternatively fed with a pneumatic or electronic type regulation of the gas valve (8) that sends gas from the fan (5) and the security valve (9).

6. The boiler according to claim 1, further comprising a detector for detecting a flame or smoke signal indicating the presence of a flame or smoke in the boiler.

7. The boiler according to claim 6, further comprising a control unit suitable for controlling every valve member (8, 11) and the fan (5) as a function of the flame or smoke signal detected by the detector.

8. The boiler according to claim 1, wherein said on/off member (30) is of an actuator-slaved type.

9. The boiler according to claim 1, wherein said on/off member (30) is of a natural movement type, subject to gravity and to the pressure of the fluid present in the feeder duct (4).

10. The boiler according to claim 1, further comprising two or more burners, each comprising a main flame diffuser element (25) and at least one auxiliary flame diffuser element (26).

11. The boiler according to claim 1, wherein each flame diffuser element (25, 26) of the burner is of a type operating with a variable modulation ratio, thus making it possible for the burner (1) to always have a variable modulation ratio even when the primary diffuser element has no flame.

* * * * *